US006369825B1

(12) United States Patent
Nakano

(10) Patent No.: US 6,369,825 B1
(45) Date of Patent: Apr. 9, 2002

(54) METHOD OF TRANSFERRING IMAGE DATA TO REDUCE TRANSITIONS OF DATA

(75) Inventor: Masashi Nakano, Sagamihara (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/426,470

(22) Filed: Oct. 26, 1999

(30) Foreign Application Priority Data

Nov. 5, 1998 (JP) ..... 10-314686

(51) Int. Cl.[7] ..... G09G 5/37
(52) U.S. Cl. ..... 345/562; 345/690
(58) Field of Search ..... 345/562, 690, 345/204, 87, 90, 104, 108

(56) References Cited

U.S. PATENT DOCUMENTS 5,268,771 A * 12/1993 Murakami et al. ..... 358/448
5,359,712 A * 10/1994 Cohen et al. ..... 395/161
6,097,401 A * 8/2000 Owen et al. ..... 345/503
6,100,863 A * 8/2000 Zhu ..... 345/89

* cited by examiner

*Primary Examiner*—Richard Hjerpe
*Assistant Examiner*—Duc Q. Dinh
(74) *Attorney, Agent, or Firm*—Marian Underweiser

(57) ABSTRACT

A first image data portion and a second image data portion differing from the first image data portion are converted so that they become similar to each other in binary notation. This conversion is performed, for example, by addition. Then, the first and second converted image data portions are transferred so that those converted portions are positioned adjacently to each other in a time-series manner. Finally, after the execution of said transferring step, the first and second image data portions are restored so that those restored portions respectively include original bits. This restoration is performed, for example, by subtraction.

14 Claims, 6 Drawing Sheets

TOTAL: 34 BLOCKS / 98 BLOCKS

METHOD OF TRANSFERRING IMAGE DATA TO REDUCE TRANSITIONS OF DATA

BACKGROUND OF THE INVENTION

1. Field of the Invention

The present invention relates generally to a method of converting (or processing) image data that is transferred to a display device. More particularly, the invention relates to an improvement for converting, transferring, and restoring data so that the amount of data change (number of data transitions) is reduced, when gray levels and the like are expressed by a finite number of bits.

2. Description of the Related Art

In cathode-ray tube (CRT) display devices that are computer-related equipments or in liquid crystal displays (LCDs) rapidly spreading in recent years, various methods have been adopted in performing display of gray levels. In displaying gray levels, brightness, for example, is expressed in terms of many intermediate levels between the lightest white and black. Gray levels are represented in image data. In some of the techniques for displaying levels, image data is divided into blocks of a finite number of bits and the gray level of the image data is represented in displayable binary notation by the bits in the block.

For instance, in the case where each data block consists of 4 bits, each bit can express two states with 0 or 1. The 4-bit block can therefore express 16 ($2^4$) states, i.e., 16 gray levels. Likewise, in the case where each data block consists of 6 bits, it is able to express 64 ($2^6$) states, i.e., 64 gray levels. In general, many drivers use a digital signal by which the number of the output levels are limited to 3 bits (8 gray levels), 4 bits (16 gray levels), 6 bits (64 gray levels), or 8 bits (256 gray levels). In order to convert the output levels representing gray levels to actual brightness, voltage levels respectively required for the gray levels are previously provided so that predetermined levels can be selectively output according to the gray levels.

Such image data of binary notation divided into blocks of a finite number of bits are often transferred in parallel via a plurality of data lines. Even if data that becomes necessary were parallel data bits transferred in parallel at a certain point, in the case where new image data is serially supplied in a time-series manner, as in the case where image data is refreshed, a transition between 0 and 1 will necessarily appear between the previous data and the next data at any of the data lines. Note that the distinction between 0 and 1 can be performed by treating a voltage less than a predetermined voltage as 0 and a voltage greater than the predetermined voltage as 1. This method is obvious to those having skill in this field.

However, in consideration of Electro-Magnetic Interference (EMI), it is preferable that transition should not occur between 0 and 1, if possible. In order to prevent EMI, there is a need to pass an allowable value (standard value) determined in specific groups and countries or throughout the world as a product or an entire system.

Such EMI radiation also arises from internal circuitry wired on a substrate, etc. However, it is often seen that the EMI radiation becomes a problem in the case where it arises from a bus or interface cable that is a set of data lines. The reason is that an interface cable has the property that it serves as an antenna for EMI radiation and increases EMI radiation as it becomes longer. Also, an interface cable or the like is in itself a component for connecting devices separated from each other, so the cable requires a certain degree of length so that it can be widely used.

In addition, there is a relation (general property) that the EMI radiation is proportional to the frequency component of a signal and becomes stronger as the repetition of a signal becomes faster. Here, attention is paid only to a certain specific bit transfered (which means any 1 bit in the 4-bit block), and a time-series change is tracked between data bits, 1 and 0, which are serially transferred. In the case where a digital signal simply repeats a logic high (1), a logic low (0), a logic high (1), and a logic low (0), the strongest EMI radiation arises. Such a state is equivalent to the case where a change in a digital quantity per a certain time period (unit time) in a time-series manner has occurred most frequently. That is, a transition has occurred most frequently between 1 and 0 being transferred adjacently in a time-series manner, and the number of signals repeated, i.e., frequency is high.

The flow of image data in an actual liquid display will be described with reference to FIG. 1.

FIG. 1 illustrates the constitution of an LCD module 10, which employs Thin Film Transistors (TFTs) as an example of the LCD. A digital data bus-clock 20 extending from a gate array 11 is elaborately connected to each of an X-driver (also called a data driver or a source driver) 30 and a Y-driver (also called a gate driver) 40. With this, the TFT on a pixel electrode specified by X and Y can be driven.

The gate array 11 in this example is also called an LCD controller 11, because it controls the supply of signals to these drivers. The LCD controller and the drivers, as hardware, are realized as internal logic devices internally wired, such as LSI circuits.

In the flow of image data being adopted here, the image data divided into data-bit blocks is serially sent from the source lines to horizontal pixels on a screen, and the gate lines are controlled. In this manner, the image data is displayed on appropriate pixels at predetermined timing. This is what is called scanning of image data. That is, image data is first sent in the horizontal scanning direction. Then, if the sending of the image data in the horizontal direction is completed, the scanning direction will be shifted in the vertical direction and image data will again be sent in the horizontal scanning direction.

FIG. 2 is a schematic diagram showing how image data transferred in a time-series manner via the digital data bus-clock 20 extending from the gate array 11 is taken out as data blocks including a finite number of bits. In data transfer, signals are generally transferred in parallel through parallel data lines from the necessity of processing data in large quantities and at high speeds.

In FIG. 2 image data is transferred in parallel through 12 data lines (excluding a clock line), which constitute a digital data bus. The 12 data lines are subdivided and exclusively used. For instance, in the case where red (R), green (G), and blue (B) are processed, the 12 data lines are exclusively used for transferring 4 bits for the gray level of red (R), 4 bits for the gray level of green (G), and 4 bits for the gray level of blue (B). Therefore, the image data can easily be taken out as 4-bit blocks.

In order to take out the 4-bit blocks from the 12-bit data transferred in parallel, it is considered that the 4 bits are serially taken out from the most significant bit (MSB) to the least significant bit (LSB), or from LSB to MSB. At this time, the time required for serially taking out data bits and the EMI radiation associated with this are not handled by the present invention, because the associated EMI radiation does not occur through a bus or interface cable that is a set of external data lines.

The 4 bits constituting a data block may be considered as being taken out at substantially the same time, even if they were taken out in a time-series manner. Various methods of taking out data bits which become a data block from the digital data bus-clock 20 is obvious to those having skill in the art, so a description thereof is omitted.

In the case where a gray level has been expressed by a block of a finite number of bits having binary numbers, consider forms of data transfer that will give rise to the problem of EMI. Although it is constant that the total number of transitions arising between the total corresponding bits of blocks to be compared with each other becomes a problem finally, initially there is a necessity of grasping the entire block which is the unit of data transfer.

The necessity of grasping the entire block is also related to how image data containing at least two kinds of data bit blocks is supplied so that it is displayed. That is, it is related to the method and direction of scanning. This results mainly from the necessity of considering the mathematical property of taking a figure up or down one place in the data block.

With this fact as a premise, the reason why the final problem of EMI is related to the total number of transitions arising between corresponding bits in data blocks to be compared with each other is due to the relation (general property) between data transfer and EMI radiation. That is, when digital signals of the same waveform are sent to n interface signals, the EMI radiation at that time becomes n times the case where the digital signal is sent to a single interface signal. For instance, when all the 4 bits in the data block make a transition, the EMI radiation becomes 4 times the case where only 1 bit makes a transition.

In the scanning method (direction) on which the embodiment of the present invention is based, image data is serially sent from source lines to the horizontal pixels on a screen and gate lines are controlled at predetermined timing. With this control, the image data is displayed at appropriate pixels. This method is a general scanning method (direction) used in LCDs. When FIG. 1 is viewed from the front, if attention is paid to a certain gate line (horizontal line or lateral line), image data will be sent from left to right along the certain gate line. Therefore, between the entire data block that is sent first to right and the next entire data block one before the first data block, comparison will become a problem. That is, if transition has occurred in any one of the bits within these blocks, the first block will differ from the next block and transition will occur.

That is, it is found that in this general data transfer by scanning, different kinds of blocks adjacent in a time-series manner become the most serious problem. However, even if blocks were not directly adjacent to each other in a time-series manner, in the case where the unit of scanning is grasped over a long period of time, it can also be said that they are adjacent in a time-series manner, because transition will finally arise sooner or later. The significance of "adjacent" and "adjacently" used herein, therefore, should not be interrupted to such a narrow meaning that indicates only the case where blocks are simply adjacent to each other, but should be interrupted widely within a range to which the present invention is applicable.

Incidentally, consider 16 states (hexadecimal notation) which can be expressed by the 4 bits in 1 block as the case where binary numbers corresponding to the hexadecimal numbers had been mathematically carried serially. Among 4 bits, the number of bits in which transition occurred (number of transitions between 0 and 1) is as follows.

| Hexadecimal notation | Binary notation | Transition (number of transitions between 0 and 1) |
|---|---|---|
| 0 | 0000 | (reference) |
| 1 | 0001 | 1 |
| 2 | 0010 | 2 |
| 3 | 0011 | 1 |
| 4 | 0100 | 3 |
| 5 | 0101 | 1 |
| 6 | 0110 | 2 |
| 7 | 0111 | 1 |
| 8 | 1000 | 4 |
| 9 | 1001 | 1 |
| 10(A) | 1010 | 2 |
| 11(B) | 1011 | 1 |
| 12(C) | 1100 | 3 |
| 13(D) | 1101 | 1 |
| 14(E) | 1110 | 2 |
| 15(F) | 1111 | 1 |
| 0 | 0000 | 4 |

It is found that the transition in the above example changes to 1, 2, 1, 3, 1, 2, 1, 4, 1, 2, 1, 3, 1, 2, 1, 4, □□□ in accordance with the mathematical, sequential carrying in binary notation.

Here , in background art, a system called gray code in which only 1-bit transition occurs between successive numbers have been devised. The gray code loses the order of the mathematical carrying with respect to binary notation and hexadecimal notation, which is listed as follows.

| Hexadecimal notation | Gray code | Transition (number of transitions between 0 and 1) |
|---|---|---|
| 0 | 0000 | (reference) |
| 1 | 0001 | 1 |
| 3 | 0011 | 1 |
| 2 | 0010 | 1 |
| 6 | 0110 | 1 |
| 7 | 0111 | 1 |
| 5 | 0101 | 1 |
| 4 | 0100 | 1 |
| 12(C) | 1100 | 1 |
| 13(D) | 1101 | 1 |
| 15(F) | 1111 | 1 |
| 14(E) | 1110 | 1 |
| 10(A) | 1010 | 1 |
| 11(B) | 1011 | 1 |
| 9 | 1001 | 1 |
| 8 | 1000 | 1 |
| 0 | 0000 | 1 |

The above transition does not follow mathematical, sequential carry. The transition changes like 1, 1, 1, 1, 1, 1, 1, 1, 1, 1, 1, 1, 1, 1, . . . It becomes possible to set all the transitions to 1. However, the gray code has the following disadvantages.

The first disadvantage is that a look-up table for taking the correspondence between gray code and binary notation becomes necessary. This can easily be understood from the fact that hexadecimal notation is independent of the original, mathematical carrying. The procedure for making a reference to the look-up table, which becomes necessary, is a redundant procedure that is desired to be omitted, if possible. Such a procedure is undesirable for realizing a high speed and simplification.

The second disadvantage is that the gray code makes sense only when the entire code is systematically handled. In the case other than that, it cannot be used. For instance, in the case where transition must be considered between 2 arbitrary (random) gray-level states taken out from the gray code, the gray code cannot be flexibly used because the transition goes to an unpredicted one.

In the case where only data with a previously known typical gray level in which data makes a transition one by one is handled, the gray code will be an extremely effective means. However, in the display of image data, as is represented by the setting of a background and characters on the background, the setting of a large difference in luminance (a large contrast in a narrow sense) is widely used for making the segmentation conspicuous.

It is considered that the reason why the above setting is widely used is for making it easy for users to identify the boundary line between segmented or partitioned areas. If such transition as data makes a transition one by one is given at a place where the aforementioned setting should be performed, the boundary line (contour) will become unclear. That is, in most cases, a drastic transition is intentionally given so that clear edges are obtained.

As a typical example of display, there is a case where letters of light luminance are displayed on a deep-black background so as to be conspicuous. It is believed that the prompting display on a disk operating system can easily be imaged.

In a typical EMI test, there are cases where a pattern of bright letters H disposed scatteringly and reiteratedly in every direction is reproduced on a dark background (see FIG. 5). The reason that such a repetitive pattern is utilized is that a great number of drastic transitions can be made to occur, because the vertical lines on both sides of the horizontal line of the letter H extend lengthwise and are crossed many times in horizontal scanning. When a countermeasure against EMI is considered, the pattern above can be considered as one of the worst states along a display of letters that is actually possible.

In addition, in the data transfer through the data lines of an LCD, if the amount of image data change is evaluated from the characteristics of the image data to be used, the number of cases where each bit changes at random will be few. In most cases, the bits will change according to a certain rule. More specifically, it is such that when there is a large amount of data change, the higher and lower bits in the data block often change at the same time.

From a relation that a gray level is expressed by a limited number of data bits, the reason that such a rule appears is closely related to the fact that the data bits are mathematically taken up or down one plate. The reason is also closely related to the fact that the states which can be expressed within the range are maximally utilized.

The above-mentioned relation will be explained with specific numerals. For example, consider the case where two gray levels (depths) are arbitrary extracted and also a gray level (depth) of 0001 is employed in the display of a background and a gray level (depth) of 1110 in the display of letters. The number of bit transitions (number of transitions between 0 and 1) is 4. In this example, higher bits (3 bits from left) and a lower bit (1 bit from right) have changed at the same time.

In addition, there is a property that a mathematically expressed state, 1111, will become 0000 if it is mathematically taken up one place and, conversely, a mathematically expressed state, 0000, will become 1111 if it is mathematically taken down one place. This property is due to the fact that 0000 and 1111 are expressed by maximally utilizing the states that can be expressed in a range of 4 bits.

After all, in the case where drastic transitions have occurred between a plurality of different image data portions in image data (at least two different image data portions), it becomes impossible to use the gray code, in which a transition is made one by one. Even in a case such as this, it is desirable that image data be transferred so that the problem of EMI does not arise, without requiring a complicated procedure.

SUMMARY OF THE INVENTION

The object of the present invention is to reduce the amount of data change (number of data transitions) during data transfer, by converting (or processing) image data that is transferred to a display device, without requiring a complicated procedure.

The present invention provides a method and apparatus for transferring image data that contains at least two different image data portions. Each of the image data portions includes a finite number of bits and represents a binary number.

First, a first image data portion and a second image data portion differing from the first image data portion are converted so that they become very similar to each other in binary notation. With this conversion, preparations are made for performing data transfer advantageous to a countermeasure against EMI.

Next, the first and second converted image data portions are transferred so that those converted portions are positioned adjacently to each other in a time-series manner. According to such transfer, the image data portion can be scanned so that transition does not arise. As a result, data transfer advantageous to a countermeasure against EMI can be realized.

Finally, the first and second image data portions are converted and restored so that those restored portions respectively include the original bits.

After all, even if image data were passed through the process of data transfer that may give rise to the problem of EMI, the transferred image data can finally be returned to the original image data. While the process of data transfer that will give rise to the EMI problem is being aimed at, the transition that will occur in the process of data transfer can be minimized.

BRIEF DESCRIPTION OF THE DRAWINGS

FIG. 6(*b*) is a diagram showing the black-painted blocks in which transition has occurred because they are adjacent in a time-series manner in the X-direction, when image data is scanned in the X-direction (horizontal direction or lateral direction)

DETAILED DESCRIPTION OF PREFERRED EMBODIMENT OF THE INVENTION

Before describing a concrete embodiment of the present invention, the definitions of the terms used in the present invention will first be described.

The "binary notation" in this specification indicates that as the information process based on the physical or technical characteristics of a computer, image data can be handled as a digital quantity. It is well known that if 4 binary notations (4 □□ 1 bit=4 bits) are gathered together, it will be equal to hexadecimal notation. Such a change is obvious to those having skill in the art. In a relation with the present invention, the final state of binary notation in which image data is actually transferred is evaluated.

When it is stated that image data portions are similar to each other, this means that the occurrence of data transition is unlikely between those image data portions. More specifically, assuming image data is divided into blocks and expressed by binary numbers, the number of 0 to 1 and 1 to 0 transitions is reduced between blocks to be compared with each other. The degree of similarity is not always related to taking a figure up or down one place, because the total number of 0 to 1 and 1 to 0 transitions between corresponding bits of the two blocks is a problem.

Therefore, when it is stated that image data portions become similar to each other, this means that the number of bits different between those image data portions is reduced, for example, by conversion. If the number of 0 to 1 and 1 to 0 transitions between image data portions or the blocks to be compared with each other is reduced, the blocks will become similar. Therefore, the order in which a figure is mathematically taken up or down one place does not necessarily have to be considered.

On the other hand, when it is stated that image data portions are the same, this means that there is no difference between the bits in the image data blocks to be compared with each other.

Figure 1:
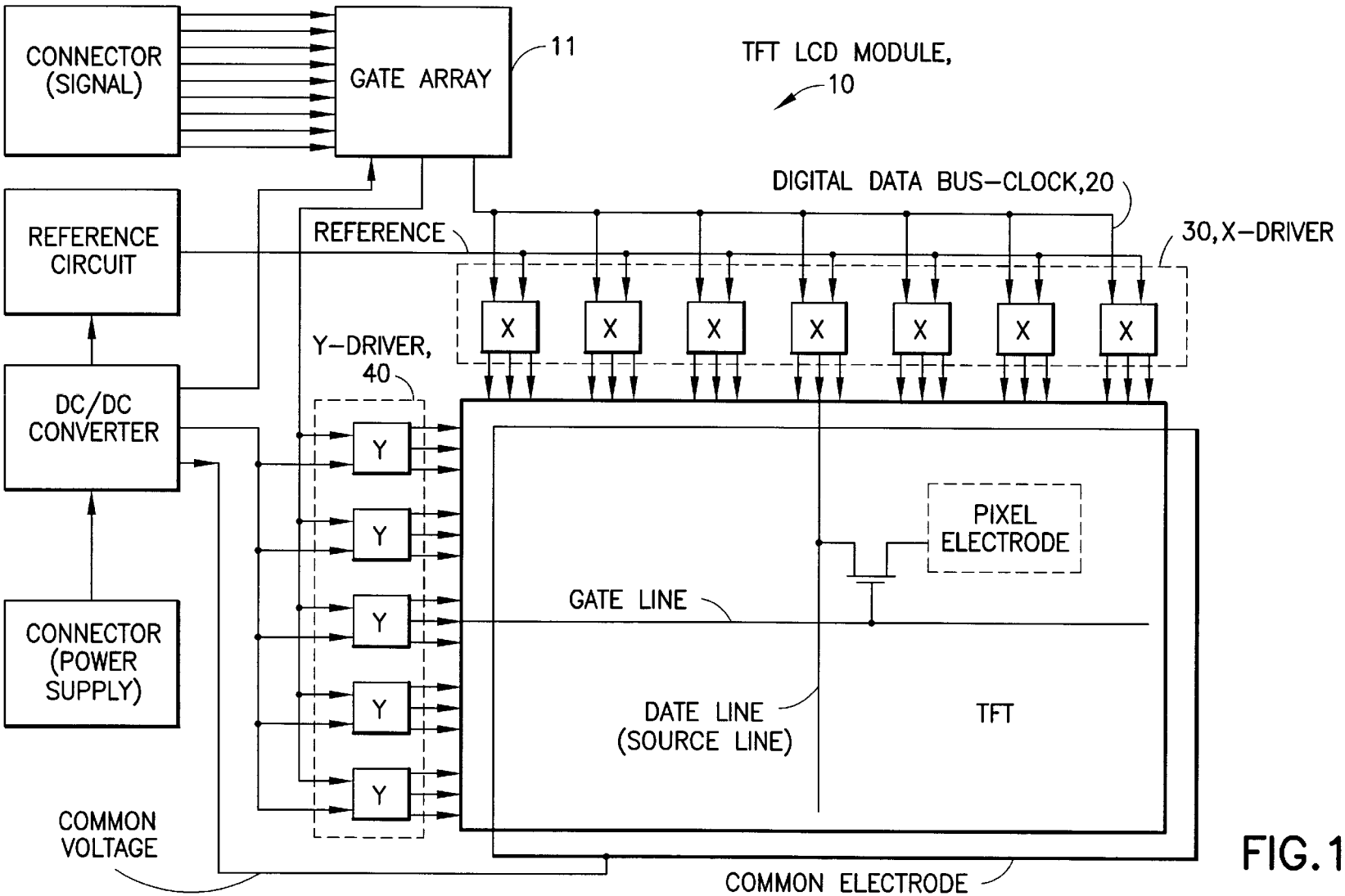
FIG. 1 is a diagram showing the constitution of a thin film transistor (TFT) module 10 as an example of an LCD in which the present invention can be implemented.
Figure 2:
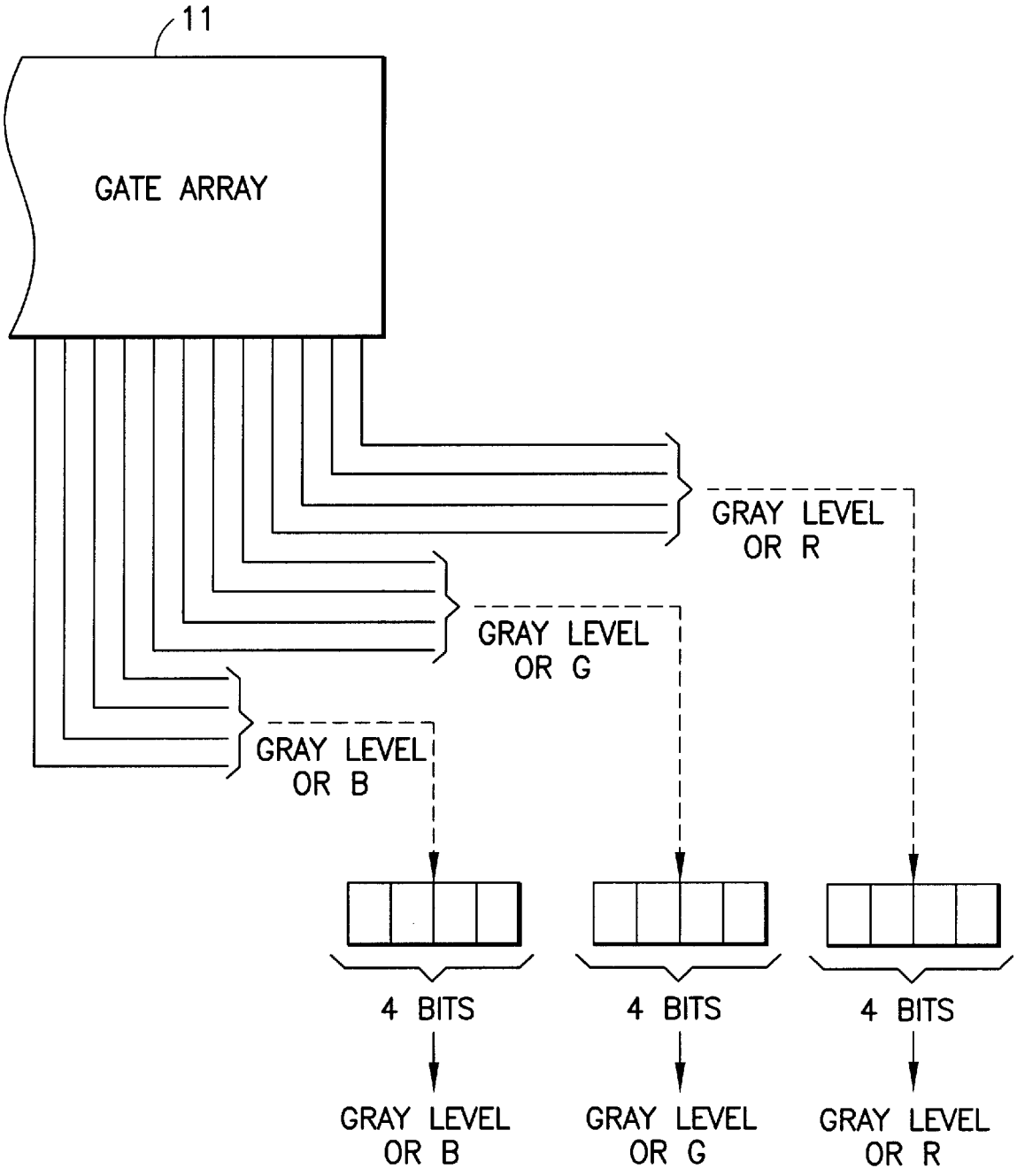
FIG. 2 is a schematic diagram showing how image data transferred in a time-series manner via the digital data bus-clock 20 extending from the gate array 11 is taken out as data blocks including a finite number of bits in scanning the image data.
Figure 3:
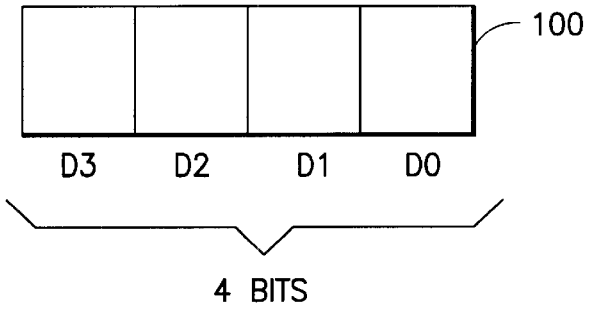
FIG. 3 is a diagram showing the structure of a 4-bit block taken out in FIG. 2 in detail.

FIG. 3 is a diagram showing the structure of a 4-bit block taken out in FIG. 2 in detail. The 4-bit block consists of D0 (least significant bit), D1, D2, and D3 (most significant bit). Of course, the order of bits may be reversed. That is, the 4-bit block may consist of D3 (least significant bit), D2, D1, and D0 (most significant bit).

Figure 4:
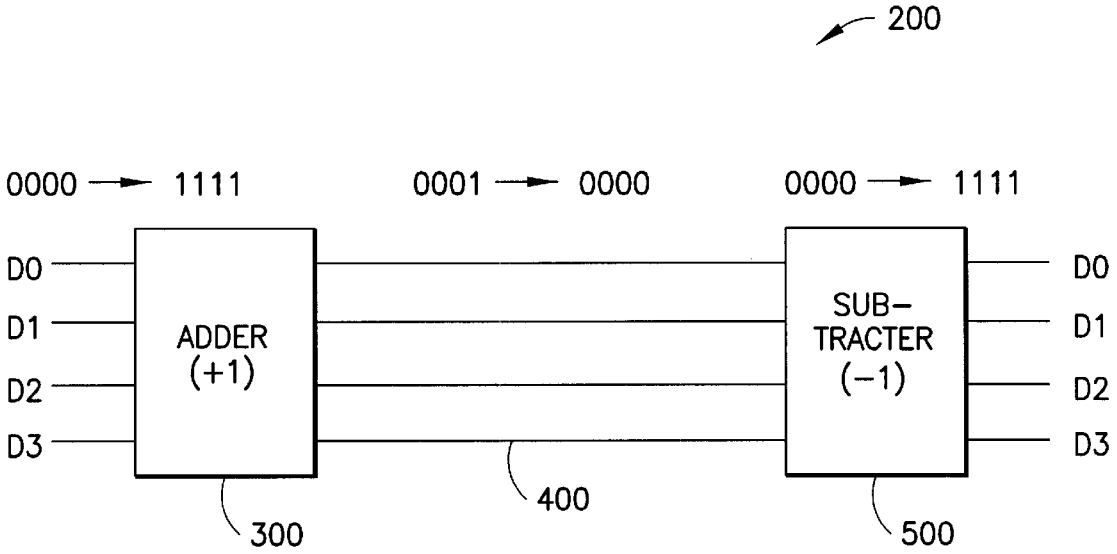
FIG. 4 is a schematic diagram showing an example of a circuit for converting and restoring data expressed with each of the data bits D0 to D3 in the 4-bit block in FIG. 3.

FIG. 4 is a schematic diagram showing an example of a circuit for converting and restoring data expressed with each of the data bits D0 to D3 in the block in FIG. 3. Here, assume that image data contains a great number of image data portions, (a) 0000 and (b) 1111. If the image data is set in this manner, a clear contour with the largest difference in brightness between the background and letters on a screen can be realized.

Here, before image data is transferred onto data lines 400, if the entire image data is processed as the preparation at an adder 300 (addition of +1), these image data portions will go to (a) 0001 and (b) 0000 (because 1111 is carried). From this it follows that the number of bit transitions, which is a maximum number of 4 before processing, can be reduced down to 1 after processing. Therefore, these 2 image data portions, i.e., 2 4-bit blocks to be compared with each other, 0000 and 1111, can be processed so that they become similar to each other (0001 and 0000), by adding only 1. As a result, the transfer of image data through the data lines 400 is significantly effective in preventing EMI.

After transfer of the image data through the data lines 400, the original image data can easily be restored, by processing the entire image data at a subtracter 500 (subtraction of 1). In a more general sense, such data processing and restoration can be described as performing the operation opposite to the operation performed on the original data following data transfer.

Therefore, even if a combination other than a combination of an adder and a substracter were adopted, those having skill in the art can easily convert and restore image data. Most importantly, two 4-bit data blocks are converted so that they are very similar to each other. This is important for the present invention.

A concrete case will next be described so that the present invention can be fully understood and that a method of evaluating the advantages of the present invention can also be understood.

Figure 5:
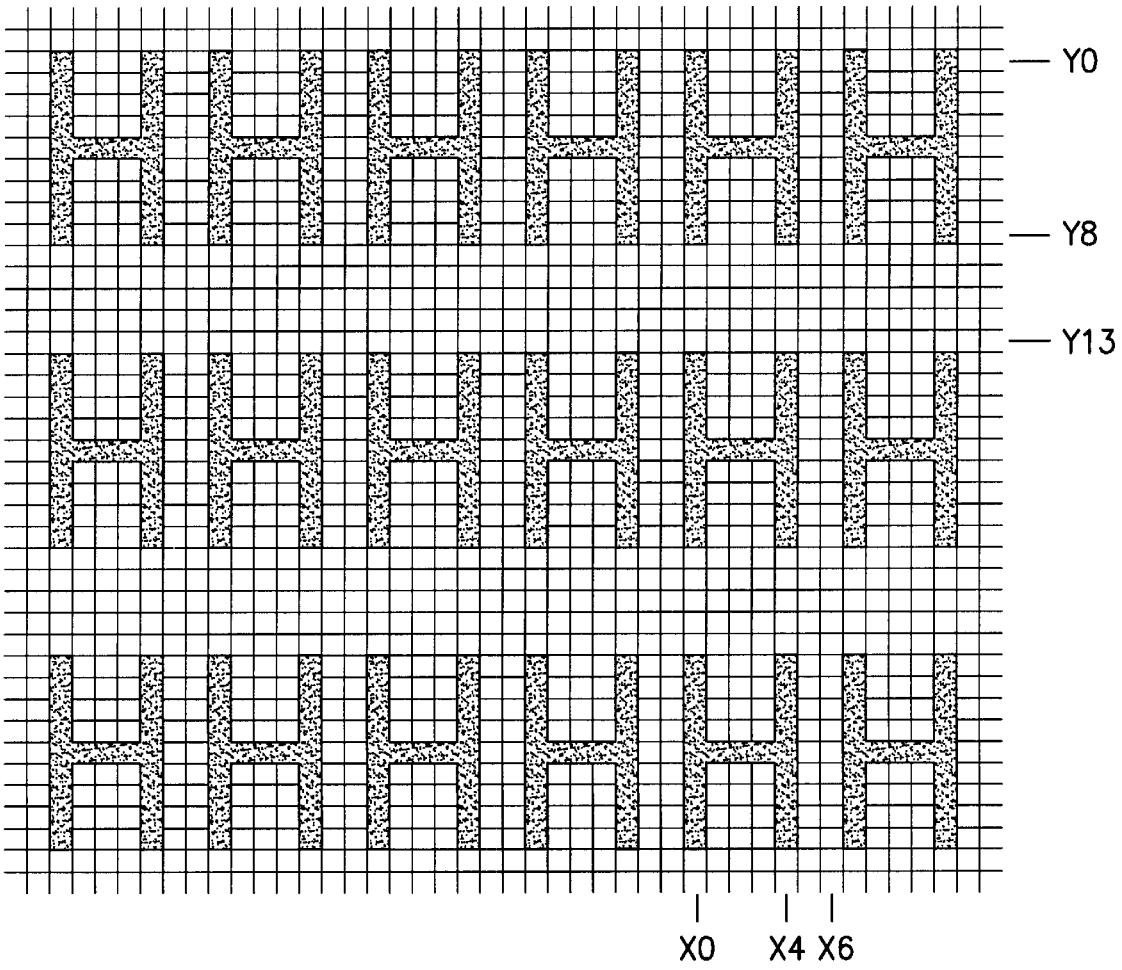
FIG. 5 is a diagram showing a pattern example of bright letters H displayed scatteringly and reiteratedly on a dark background in every direction, which is employed in a typical EMI test.

FIG. 5 illustrates a pattern example of bright letters H displayed scatteringly and reiteratedly on a dark background in every direction, which is employed in a typical EMI test. One of the letters H is shown on an enlarged scale in FIG. 6(*a*). Though usually the actual letter H is displayed brightly. In the figure, in view of expression by a drawing, the black portion represents the bright letter H and the white portion represents the dark background portion. Of course, conversely, there are cases where the background portion is bright and the letter portion is dark. Unit blocks X0–X6 are given in the X-direction (horizontal direction or lateral direction), while unit blocks Y0–Y13 are given in the Y-direction (vertical direction or longitudinal direction). Therefore, the total number of blocks prepared is 7×14=98 blocks. Each block corresponds to a pixel for displaying the pattern of letters H and is constructed of 4 bits.

Figure 6:
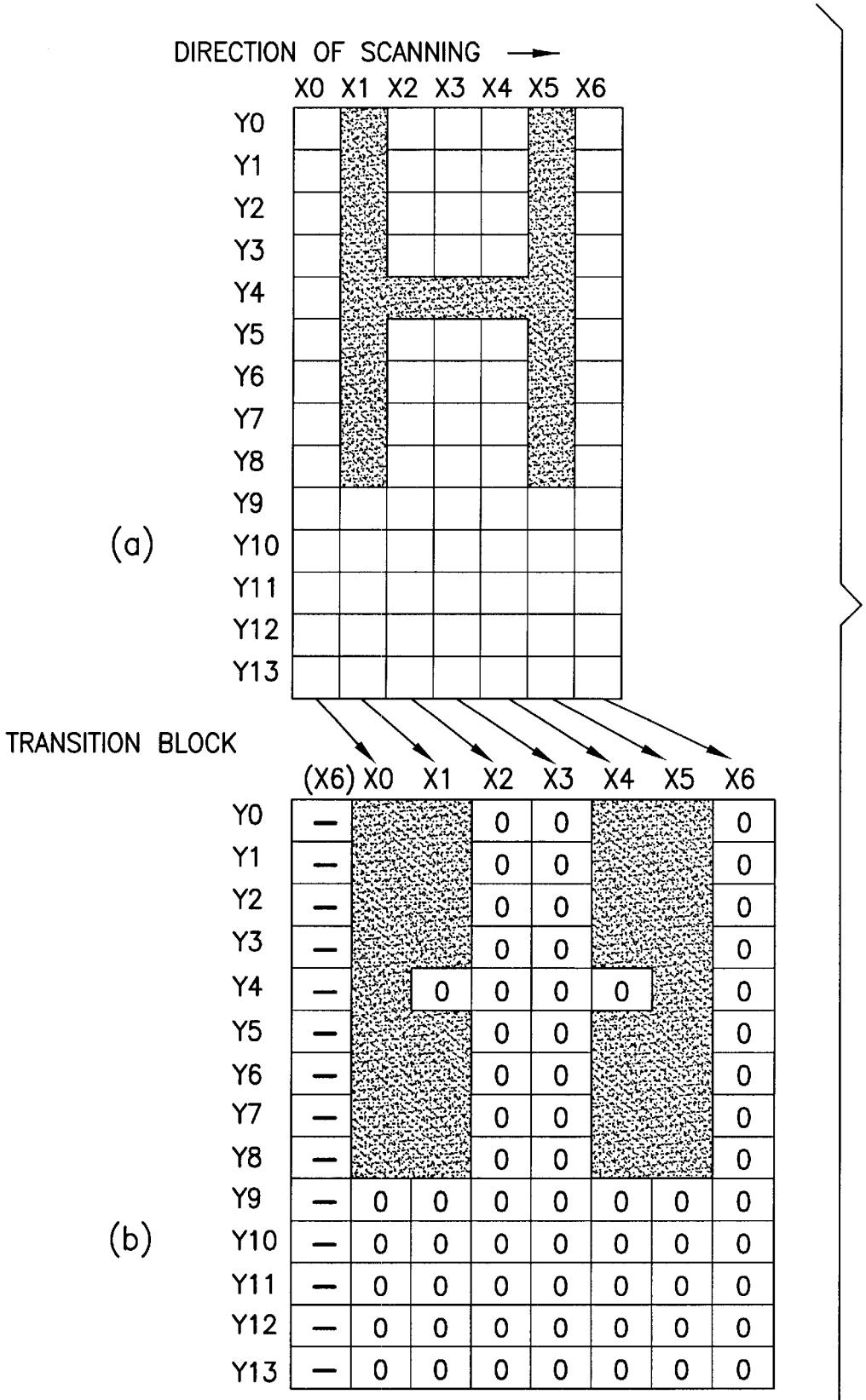
FIG. 6(*a*) is an enlarged view showing one of the letters H in FIG. 5.

In the case where image data is scanned in the X-direction (horizontal direction or lateral direction), when transition arises between blocks (pixels) adjacent in the X-direction because they are adjacent in a time-series manner in the X-direction, such blocks (pixels) are painted black, as shown in FIG. 6(*b*). It has been found that transition has occurred in 34 blocks (pixels) of the H-pattern.

In the Y direction (vertical direction or longitudinal direction), there is a difference (delay) equivalent to the time period during which the scanning in the X-direction is completed. This difference (delay) is a much longer period of time, compared with the time period during which bit blocks adjacent in a time-series manner are scanned. According to the scanning method (direction) in the X-direction, blocks adjacent in the Y-direction do not become a problem. In the H-pattern, the rate of the number of blocks in which transition has occurred with respect to all blocks (the area rate, if the number of pixels is considered), is 34÷98 ≈0.35 (=35%).

According to this typical pattern, as previously described, two vertical lines on both sides of the horizontal line of the letter H can cause a drastic transition to occur when horizontal scanning is performed.

Figure 7:
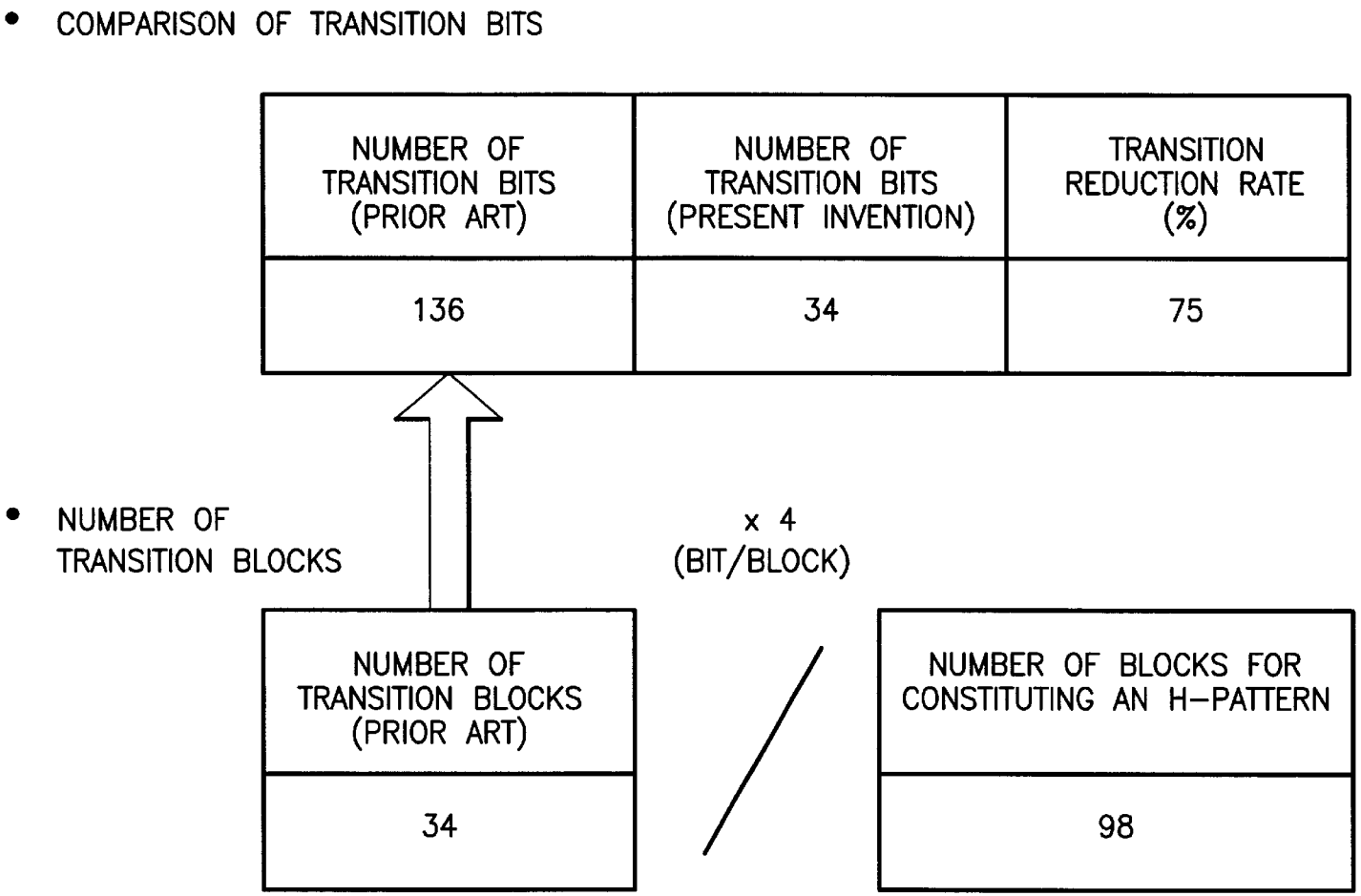
FIG. 7 is a diagram showing that the number of bits that made a transition can finally be calculated, if the number of blocks in which transition occurs is specified.

FIG. 7 shows that the total number of bits that made a transition can finally be calculated. This will hereinafter be described with specific numeric values.

Here, consider again the case where 1 block is constructed of 4 bits, like the block described in FIG. 4. Assume that image data is constructed only by two kinds of image data portions, (a) 0000 and (b) 1111. Before the image data is transferred onto the data lines 400, the entire image data is processed as the preparation by the adder 300 (addition of 1). Then, the processed image data is transferred onto the data line 400. After the image data is transferred the entire image data is processed by the subtracter 500 (subtraction of 1) in order to restore the original image data.

In the conventional method, all the 4 bits in 1 block make a transition, while in the present invention only 1 bit makes a transition. As a result, the number of transitions can be reduced by 75%. This way the reduction effect is evaluated on a block-by-block basis.

While the embodiment of the present invention has been described with reference to the internal data buses of an LCD, the technical concept of the invention is widely applicable to data buses widely used between a personal computer (PC) and a CRT display, data buses in the interior of a device that has a plurality of data lines and also transfers data, such as a CPU, and buses between devices.

Finally, in the present invention, although it has been described that the blocks including a finite number of bits are employed to represent gray levels, they can be employed to represent other characteristics and attributes of image data other than gray levels. Such changes and modifications will be apparent to those having skill in this field. Therefore, unless these changes and modifications otherwise depart from the scope of the present invention, they should be construed as included therein.

What is claimed is:

1. A method of displaying image data on a display device, said image data containing at least two different image data portions, each of the image data portions including a finite number of bits representing a binary number in binary notation, the method comprising the steps of:

converting a first image data portion and a second image data portion differing from said first image data portion so that said first and second image data portions become similar to each other in binary notation;

transferring to the display device said first and second converted image data portions so that those converted portions are positioned adjacently to each other in a time-series manner; and consequently to carrying out said transferring step, restoring said first and second image data portions so that those restored portions respectively include the original bits before carrying out said conversion step.

2. The method as set forth in claim 1, wherein said binary number represented by any of said first and second data portions corresponds to a gray level of the image data.

3. The method as set forth in claim 1, wherein said conversion step includes a step of converting said first and second image data portions so that they are similar to each other as a sequence of said finite number of bits.

4. The method as set forth in claim 1, wherein said first and second image data portions are converted by addition of 1.

5. The method as set forth in claim 4, wherein said first and second image data portions are restored by subtraction of 1.

6. The method as set forth in claim 1, wherein said first and second image data portions are converted by subtraction of 1.

7. The method as set forth in claim 6, wherein said first and second image data portions are restored by addition of 1.

8. An apparatus for displaying image data on a display device, said image data containing at least two different image data portions, each of the image data portions including a finite number of bits representing a binary number in binary notation, the apparatus comprising:

a circuit adapted to convert a first image data portion and a second image data portion differing from said first image data portion so that said first and second image data portions become similar to each other in the binary notation;

a circuit adapted to transfer to the display device said first and second converted image data portions so that those converted portions are positioned adjacently to each other in a time-series manner; and a circuit adapted to restore said first and second image data portions so that those restored portions respectively include the original bits before carrying out said conversion step.

9. The apparatus as set forth in claim 8, wherein said binary number represented by any of said first and second data portions corresponds to a gray level of the image data.

10. The apparatus as set forth in claim 8, wherein said conversion circuit includes a circuit adapted to convert said first and second image data portions so that they are similar to each other as a sequence of said finite number of bits.

11. The apparatus as set forth in claim 8, wherein said conversion circuit includes a circuit adapted to convert said first and second image data portions by addition of 1.

12. The apparatus as set forth in claim 11, wherein said restoration circuit includes a circuit adapted to restore said first and second image data portions by subtraction of 1.

13. The apparatus as set forth in claim 8, wherein said conversion circuit includes a circuit adapted to convert said first and second image data portions by subtraction of 1.

14. The apparatus as set forth in claim 13, wherein said restoration circuit includes a circuit adapted to restore said first and second image data portions by addition of 1.

* * * * *